US009666984B2

(12) United States Patent
Wanschoor et al.

(10) Patent No.: US 9,666,984 B2
(45) Date of Patent: May 30, 2017

(54) CONNECTION SYSTEM FOR A CONNECTOR

(71) Applicant: Amphenol Air LB, Carignan (FR)

(72) Inventors: Anthony Wanschoor, Le Chesne (FR); Davy Montet, Vendresse (FR); Christian Nicouleau, Pouru-Saint-Remy (FR); Gaspard Cayzac, Margut (FR)

(73) Assignee: Amphenol Air LB, Carignan (FR)

( * ) Notice: Subject to any disclaimer, the term of this patent is extended or adjusted under 35 U.S.C. 154(b) by 0 days.

(21) Appl. No.: 15/052,692

(22) Filed: Feb. 24, 2016

(65) Prior Publication Data

US 2016/0248201 A1 Aug. 25, 2016

(30) Foreign Application Priority Data

Feb. 25, 2015 (FR) ..... 15 51619

(51) Int. Cl.

| | |
|---|---|
| ***H01R 13/629*** | (2006.01) |
| ***H01R 13/641*** | (2006.01) |
| ***H01R 13/658*** | (2011.01) |
| ***H01R 24/66*** | (2011.01) |

(52) U.S. Cl.

CPC . *H01R 13/62922* (2013.01); *H01R 13/62911* (2013.01); *H01R 13/641* (2013.01); *H01R 13/658* (2013.01); *H01R 24/66* (2013.01)

(58) Field of Classification Search

CPC .. H01R 13/62; H01R 13/5219; H01R 13/641; H01R 13/62911; H01R 13/62922

USPC ..... 439/157, 271, 489

See application file for complete search history.

(56) References Cited

U.S. PATENT DOCUMENTS

| | | | | |
|---|---|---|---|---|
| 6,244,880 | B1 * | 6/2001 | Fukase | H01R 13/62911 439/157 |
| 6,341,968 | B1 * | 1/2002 | Grant | H01R 13/62938 439/157 |
| 6,361,362 | B1 * | 3/2002 | Kressmann | H01R 13/743 439/157 |
| 6,641,423 | B1 * | 11/2003 | Giro | H01R 13/62977 439/157 |
| 6,773,279 | B2 * | 8/2004 | Yamashita | H01R 13/62977 439/157 |
| 6,824,406 | B1 * | 11/2004 | Sharples | H01R 13/62977 439/157 |
| 6,979,213 | B1 * | 12/2005 | Mauney | H01R 13/193 439/157 |
| 7,238,050 | B2 * | 7/2007 | Sakakura | H01R 9/032 439/157 |
| 7,329,132 | B1 * | 2/2008 | Kamath | H01R 13/193 439/157 |
| 7,335,037 | B2 * | 2/2008 | Razafiarivelo | H01R 13/62911 439/157 |

(Continued)

*Primary Examiner* — Gary Paumen

(74) *Attorney, Agent, or Firm* — Christensen O'Connor Johnson Kindness PLLC

(57) ABSTRACT

The connection system for at least one pair of paired connectors includes a plate (2) including an opening for each pair of connectors, to which is attached a first connector of said pair and a bolt (4) that can be moved laterally in relation to the plate and to the first connector, said bolt (4) being moveable to a first position that enables insertion of the second connector of said pair until contact is made between the connectors and to a second stable coupling and locking position of the connectors.

10 Claims, 5 Drawing Sheets

(56) References Cited

U.S. PATENT DOCUMENTS

Figure 1:
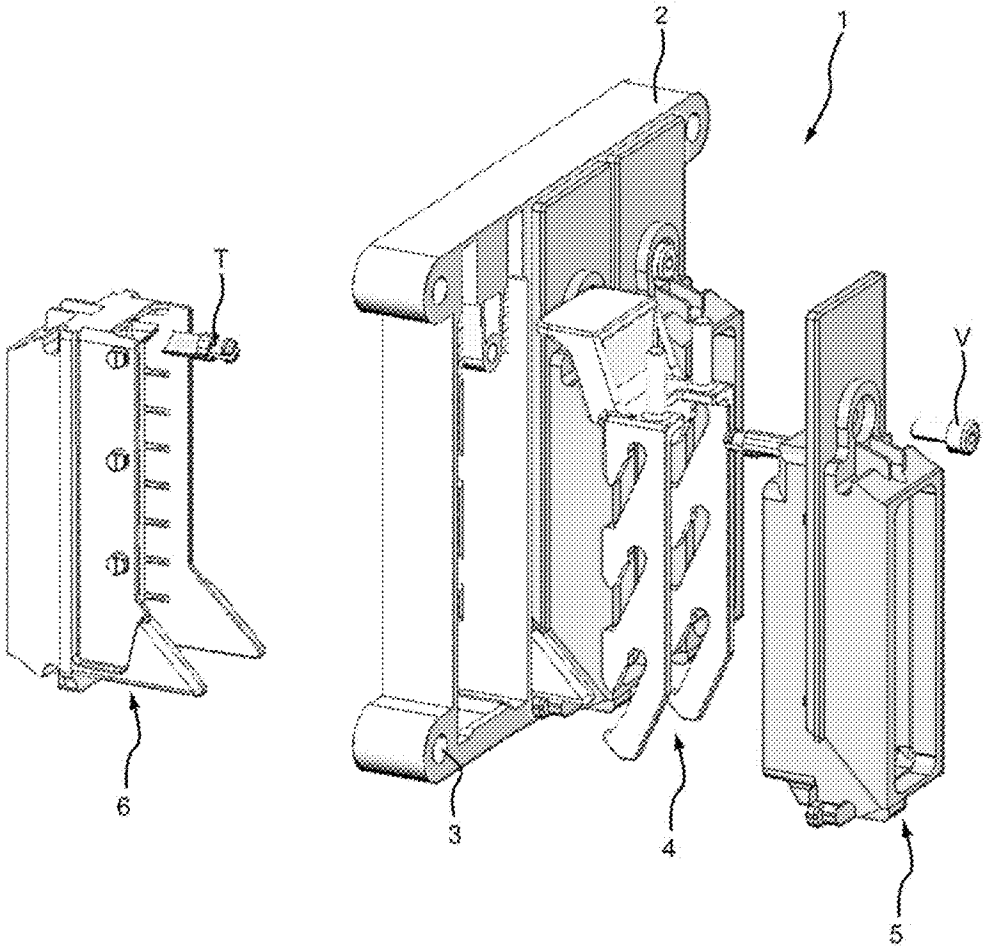

| | | | | |
|---|---|---|---|---|
| 7,419,392 | B2 * | 9/2008 | Tsuji | H01R 13/62927 439/157 |
| 7,497,706 | B2 * | 3/2009 | Daudin | H01R 13/514 439/157 |
| 7,704,086 | B2 * | 4/2010 | Gimbel | H01R 13/5202 439/157 |
| 8,992,240 | B2 * | 3/2015 | Shiga | H01R 13/62911 439/157 |
| 2002/0090849 | A1 * | 7/2002 | Shuey | H01R 13/62911 439/157 |
| 2004/0002240 | A1 * | 1/2004 | Konda | H01R 13/62905 439/157 |
| 2006/0270258 | A1 * | 11/2006 | Ohtaka | H01R 13/62938 439/157 |
| 2007/0207646 | A1 * | 9/2007 | Tsuji | H01R 13/62927 439/157 |
| 2007/0232100 | A1 * | 10/2007 | Tyler | H01R 13/4365 439/157 |
| 2009/0317993 | A1 * | 12/2009 | Komiyama | H01R 13/5208 439/157 |

* cited by examiner

CONNECTION SYSTEM FOR A CONNECTOR

The invention relates in general to the electrical connection and mechanical attachment of connectors.

Such connectors can be used to carry power or control signals. They include for example a set of contact modules, respectively male and female, that are designed to cooperate when the connection is made.

Assembly of the connectors requires assembly forces that may be significant depending on the density of points, i.e. contacts, to be connected. These forces are related to interpenetration of the contacts with one another. Indeed, the male contacts have to come into contact with the female contacts, which have a clamping effect and which generate a resistance opposing assembly. If the contacts are genderless, the clamping is provided on either side of the connector and the assembly forces can also be significant.

Furthermore, assembly speed creates cost issues relating to installation and maintenance times for connectors. The use of tools reduces this speed and permanently occupies one hand of an operator.

Finally, it must be possible to quickly check that the connectors are correctly locked, which may not be compatible with conventional screwing connection systems since the tightening torques cannot be determined visually, or with conventional clip or quarter-turn connection systems that can be partially locked, in which case the imperfect connection cannot be detected by visual examination.

In consideration of the foregoing, the objective of the invention is to propose a system for connecting connectors that does not require any tools to couple or uncouple the system, that is easy to implement with one hand, and that helps with assembly and disassembly in order to reduce the coupling and uncoupling forces.

The invention therefore relates to a connection system for at least one pair of paired connectors including a plate including an opening for each pair of connectors, to which is attached a first connector of said pair and a bolt that can be moved laterally in relation to the plate and to the first connector, said bolt being moveable to a first position that enables insertion of the second connector of said pair until contact is made between the connectors and to a second stable coupling and locking position of the connectors.

The first position therefore corresponds to an open position of the bolt, in which the lock is for example in a retracted position, while the second position corresponds to a closed position of the bolt in which the bolt is for example in an advanced position.

According to another feature of the connection system according to the invention, the bolt includes an assembly of at least one first ramp against which bears a pin provided on the second connector when the bolt is moved to the second position.

The bolt may also include an assembly of at least one second ramp parallel to the first ramp and against which the pin bears when the bolt is moved to the first position to uncouple the connectors.

In one embodiment, the ramps open out into a locking indentation.

According to another feature, the first and second connectors have respectively an end base provided with attachment means to the plate and a plug carrying the pin or pins.

In one embodiment, the second connector has a handle for controlling the movement of the bolt to the first retracted position.

In this case, there is advantageously an elastic return element pushing the bolt into the first position.

There is also advantageously a visual marker placed on the path of the bolt that is visible only when the bolt is in the locked position.

In one embodiment, the system includes a layer of compressible material designed to be compressed at the end of the coupling path of the connectors or at the beginning of the uncoupling path of the connectors.

In one embodiment, the system includes a protective cover against electromagnetic radiation.

Figure 2A:
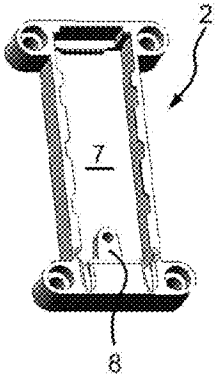
Figure 2B:
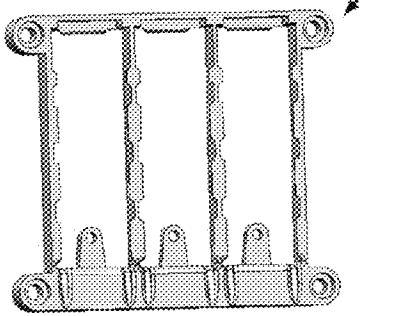
Figure 2C:
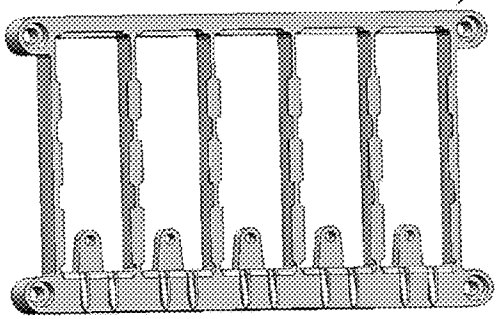
Figure 3:
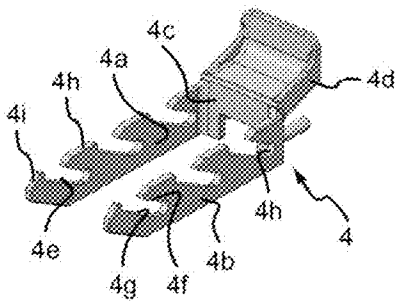
Figure 4:
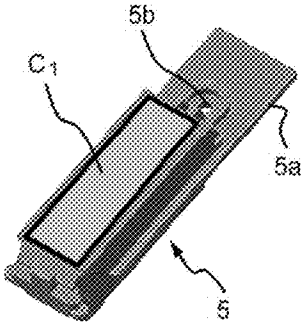
Figure 5:
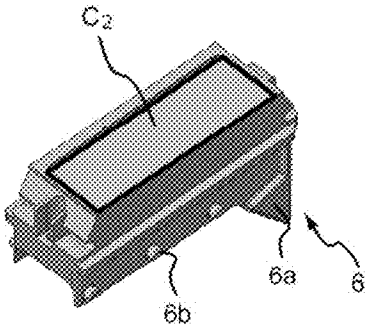

Other objectives, features and advantages of the invention are set out in the description below, given purely by way of non-limiting example and in reference to the attached drawings, in which:

FIG. 1 is a perspective exploded view of a connection system according to the invention, FIGS. 2*a*, 2*b* and 2*c* show different embodiments of the plate in the system in FIG. 1, FIG. 3 shows the bolt in the connection system in FIG. 1, FIGS. 4 and 5 show respectively the base and the plug of the first and second connectors, FIGS. 6*a* to 6*i* show the assembly process of the connectors using a connection system according to the invention, and FIGS. 7*a* to 7*f* show the uncoupling process of the connectors using a connection system according to the invention.

Reference shall first be made to FIGS. 1 to 5, which show the main elements of a connection system for paired connectors according to the invention, indicated using general reference sign 1.

In the application considered, which is in no way limiting, this connection system 1 is designed to help connect two connectors, respectively male and female, for an avionic application.

As is known, connectors conventionally include a set of contact modules, having a set of male or female contacts provided at the conductor ends to be connected.

As shown in FIG. 1, the connection system essentially includes a plate 2 provided with slits 3, in this case four, for attaching the connection system to an assembly support; a bolt 4 that can be moved transversally, i.e. in the plane of the plate 2, between a retracted first position corresponding to an open position of the bolt and an advanced second position corresponding to a closed position of the bolt; a base 5 that is provided at one extremity of a first connector to be paired and that is attached to the plate 2; and a plug 6 provided at one extremity of a second connector to be paired.

As shown in FIGS. 2*a* and 2*b*, the plate 2 includes a set of openings 7, the number of which depends on the number of connectors to be connected. Although the number of openings is not limiting, in the different embodiments shown, the plate 2 may have one, three or five openings for connecting one, three or five pairs of connectors.

For each opening, the plate has one leg 8 for screwing on the base 5 of the first connector. The peripheral edge of each opening 7 also includes a set of reliefs forming a pattern used to receive the base 5.

The bolt 4 is essentially U-shaped and has two lateral branches 4*a* and 4*b* joined by a base 4*c* provided with a curved upper leg 4*d* designed to be moved manually.

Each branch 4*a* and 4*b* of the bolt has a set of slots, such as 4*e*, each delimiting a first ramp 4*f* and a second ramp 4*g* extending in parallel and used respectively during connection or uncoupling of the connectors. As shown, each of the slots 4*e* opens out into an end indentation 4*h*.

With reference to FIG. 4, the base 5, which is provided at one extremity with a first connector to be connected, comprises an assembly part that receives the first connector C1, or that is formed as a single part with this latter, and that comprises, in this example, an end leg 5*a* provided with an orifice 5*b* for attachment of the base using a screw V (FIG. 1) to the plate 2. Naturally, alternatively, any other suitable means may be used to attach the base to the plate, such as clipping or welding.

As shown in FIG. 5, the plug 6 is also an assembly part that receives the second connector C2 to be connected, or that is formed as a single part with this latter.

It essentially comprises a handle 6*a* that is designed to move the bolt at the beginning of the connection phase and a set of pins 6*b*, the number of which corresponds to the slots 4*e* and that are designed to cooperate with the ramps 4*f* and 4*g* firstly during coupling and secondly during uncoupling of the connectors. The number and position of the pins and slots is selected such as to enable a translational movement of the plug along the axis of the contacts during movement of the bolt.

Returning to FIG. 3, in order to facilitate the movement of the bolt 4, the end zone of the legs 4*a* and 4*b* includes an inclined ramp, for example 4*i*, against which the extremity of the handle 6*a* bears.

Reference is now made to FIGS. 6*a* to 6*i*, which show the connection process of the two connectors using the connection system described above.

The first connector and the base it carries are fixed, being screwed to the plate 2, while the plug and the corresponding connector form a removable movable portion that is separate from the connection system until it is connected.

Moreover, before the method for connecting the connectors is implemented, the bolt 4 is inserted into the opening of the plate and enters the plate 3 and the base 5 such that the leg 4*d* is accessible from the side of the plate 2 opposite the base 5.

During a first phase, the plug 6 of the second connector, which in this case is a female connector, moves towards the plate 2, until the handle 6*a* bears against the end ramp 4*i* of the bolt. When the plug 6 is more engaged in the plate, the bolt is moved laterally to a retracted position (FIGS. 6*b* and 6*c*) enabling the complete insertion of the second connector to bring the first and second connectors into contact. This movement is advantageously made against a return force exerted by an elastically deformable element, such as a spring R interposed between the bolt and the plate. As explained below, the spring R is optional. Furthermore, the presence of one or more poka-yokes in the form of T-rods that are inserted into a corresponding orifice formed in the plate ensures that the plug is inserted correctly with the base during insertion of same in the plate.

During movement of the plug 6 in relation to the bolt, the pins 6*b* are engaged in the slots 4*e*. The position shown in FIG. 6*b*, in which the pins 6*b* are positioned level with the entrance of the slots, represents the male and female contacts of the connectors coming into contact. The position 6*c* represents the end-of-travel position of the bolt 4 in the retracted position.

During the following stage (FIG. 6*d*), the bolt is moved forward manually by actuating the end handle 4*d* of the bolt. This phase corresponds to the start of the assistance phase for connecting the connectors. When the bolt is moved to the advanced position, the pins 6*b* bear against the ramp 4*f* of the slots 4*e* until they reach the end indentation 4*h* (FIG. 6*f*), which corresponds to the end of the assistance phase.

Figure 6A:
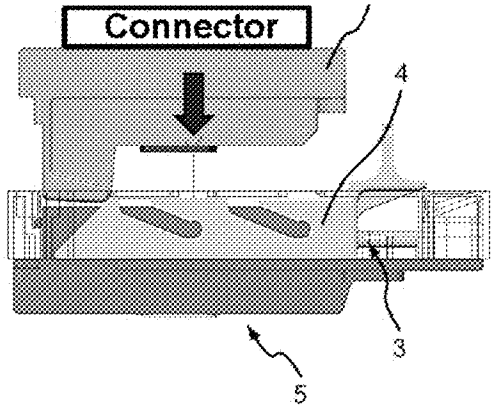
Figure 6B:
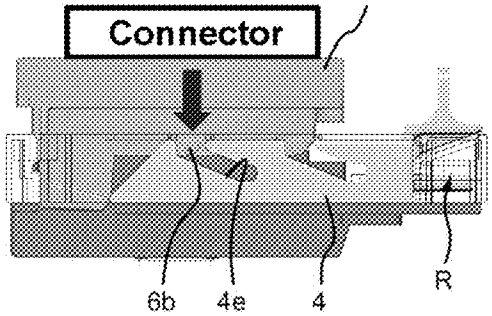
Figure 6C:
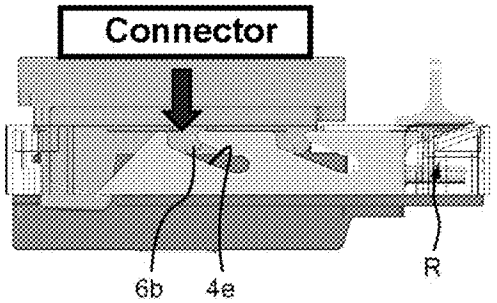
Figure 6D:
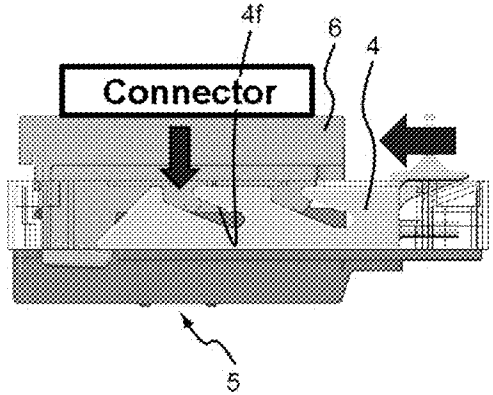
Figure 6E:
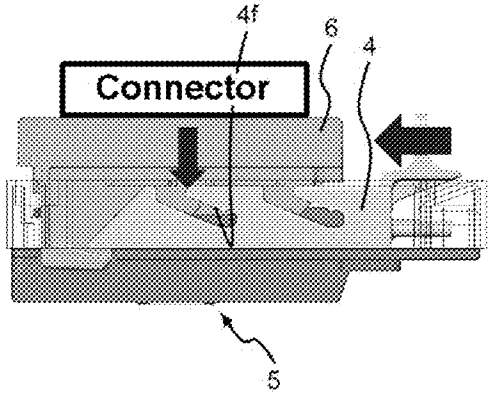
Figure 6F:
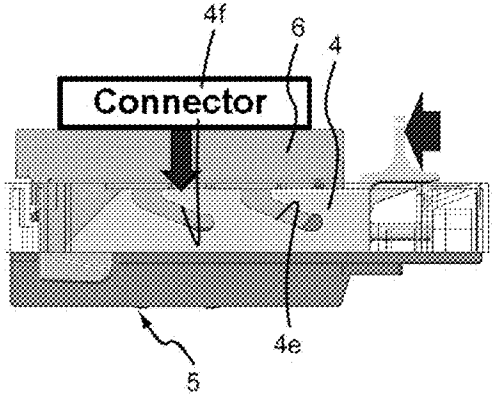
Figure 6G:
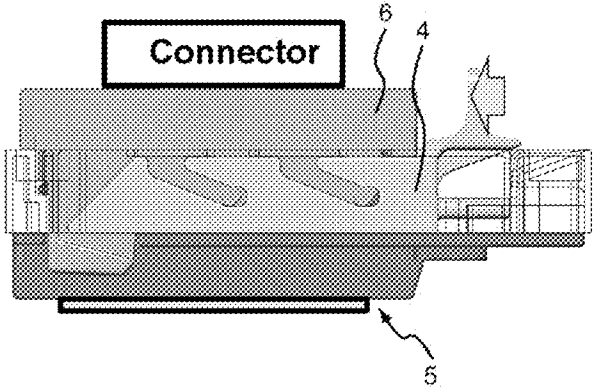
Figure 6I:
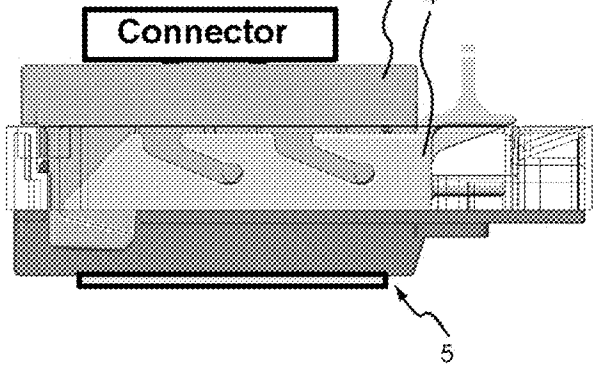
Figure 6H:
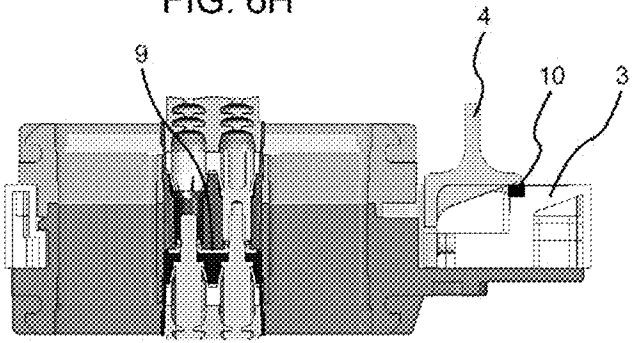

With reference to FIGS. 6*g* and 6*h*, in which the base and the plug have been removed and which shows an internal view of a contact module, it can be seen that an additional force applied manually causes the compression of a compressible material 9 provided between the connectors such that moving the pins into the indentation 4*h* requires an additional force that is easily identifiable by the operator. This material may for example be obtained by overmoulding silicone.

In the position shown in FIG. 6*i*, the two connectors are perfectly connected, the bolt being held in the advanced position by the pins engaged stably in the indentations.

It can also be seen how, in this position, the correct connection of the connectors can be visually checked using a visual marker 10 provided on the plate that is only visible if the bolt is in the fully advanced position.

Figure 7A:
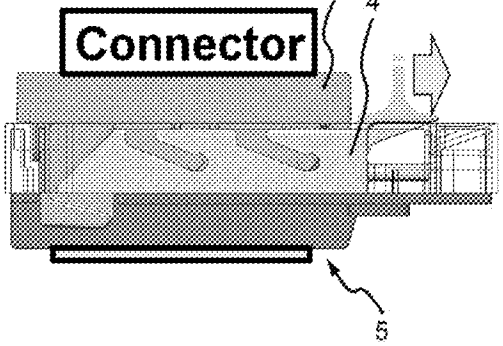
Figure 7B:
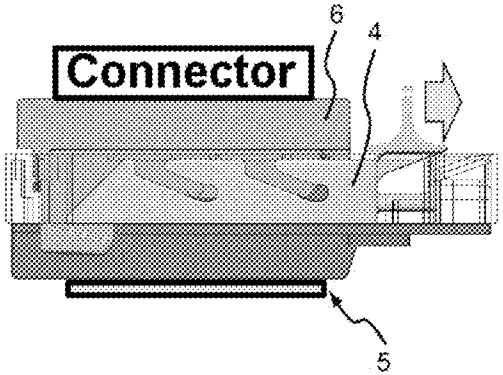
Figure 7C:
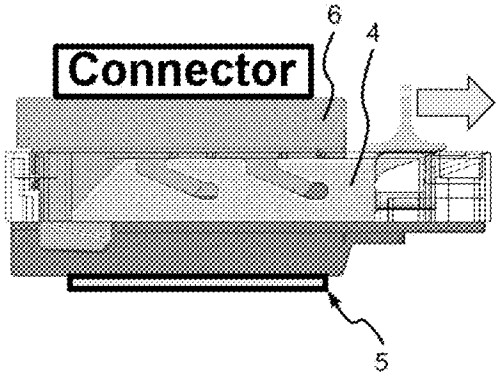
Figure 7D:
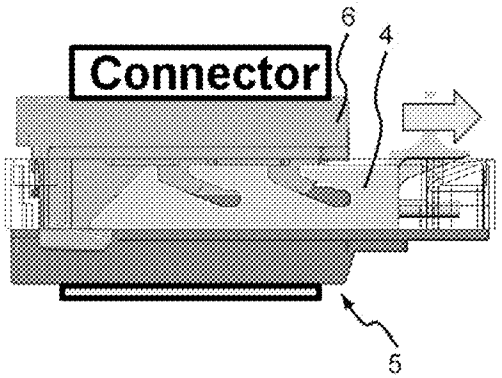
Figure 7E:
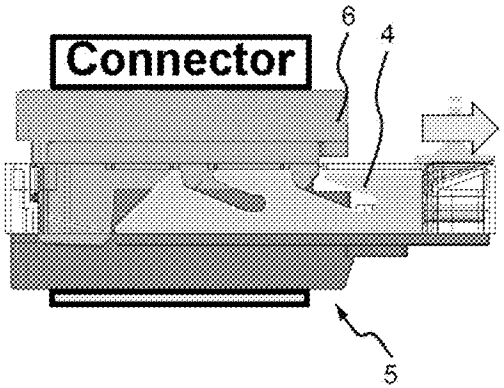
Figure 7F:
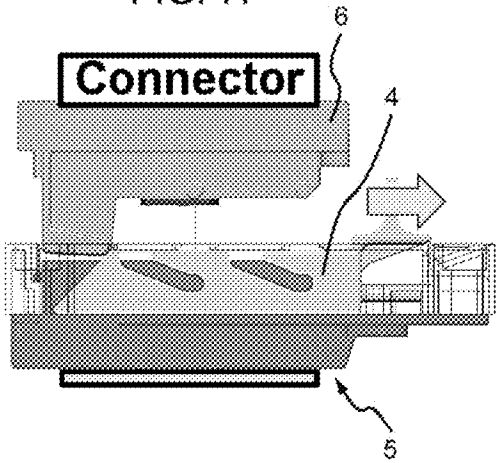

Reference is made finally to FIGS. 7*a* and 7*f*, which show how the connection system according to the invention is also designed to help uncouple connectors. Uncoupling is achieved by manually moving the bolt to the advanced position.

With reference firstly to FIG. 7*a*, to achieve this uncoupling, an adequate force must first be exerted on the bolt to compress the compressible material provided between the connectors in order to disengage the pins from the indentations 4*h*.

The bolt can then be retracted (FIGS. 7*b* to 7*e*) to uncouple the contacts, using the second ramp 4*g* against which the pins 6*b* bear. This movement is made against the force exerted by the return spring R.

When the bolt has reached the end of travel, the male contacts are fully removed from the female contacts and the plug is in the retracted position. Once the bolt has been moved in full to the advanced position, the plug is free and can be removed manually.

Furthermore, the system described above can also be provided with a cover made of an electrically conductive material (not shown) to create an electromagnetic shield.

Finally, the invention described is not limited to the embodiment considered.

Indeed, the embodiment described uses a handle 6*a* provided on the plug to return the bolt to the retracted position, in cooperation with a ramp on the bolt 4. Alternatively, instead of the handle and the ramp, the bolt may be held in the retracted position before assembly of the plug 6. Any known removable means for holding the bolt may be used to temporarily retain the bolt, such as a spring-mounted ball bearing, controlled clamping of the bolt between the plate 2 and the base 5 or a retaining clip. In this case, the return spring is no longer required and may be omitted.

The invention claimed is:

1. Connection system for at least one pair of paired connectors, wherein it includes a plate (2) including an opening (7) for each pair of connectors, to which is attached a first connector of said pair and a bolt (4) that can be moved laterally in relation to the plate and to the first connector, said bolt (4) being moveable to a first position that enables insertion of the second connector of said pair until contact is made between the connectors and to a second stable coupling and locking position of the connectors, wherein the bolt includes an assembly of at least one first ramp (4*f*) against which bears a pin (6*b*) provided on the second connector when the bolt is moved to the second position and an assembly of at least one second ramp (4*g*) parallel to the first ramp and against which the pin bears when the bolt is moved to the first position to uncouple the connectors, the first and second ramps delimiting a slot (4*e*) and open out into a locking indentation (4*h*) against which bears the pin (6*b*) in the second position, and wherein the second connector having a handle (6*a*) for controlling the movement of the bolt to the first position by contacting an end of said bolt.

2. System according to claim 1, characterised in that the first and second connectors have respectively an end base (5) provided with attachment means to the plate and a plug (6) carrying the pin or pins.

3. System according to claim 1, comprising an element for holding the bolt in the first position.

4. System according to claim 1, characterised in that the plate includes a visual marker (10) placed on the path of the bolt that is visible only when the bolt is in the locked position.

5. System according to claim 1, comprising a layer of compressible material (9) designed to be compressed at the end of the coupling path of the connectors or at the beginning of the uncoupling path of the connectors.

6. System according to claim 1, comprising a protective cover made of an electrically conductive material against electromagnetic radiation.

7. System according to claim 1, wherein the bolt comprises two lateral branches (4*a*, 4*b*) joined by a base (4*c*) provided with a curved upper leg (4*d*) designed to be moved manually.

8. System according to claim 7, wherein each lateral branch has a set of slots (4*e*) engaging with a set of pins (6*b*) provided on the second connector.

9. System according to claim 7, wherein an end zone of each lateral branch includes an inclined ramp (4*i*), against which bears the end of the handle (6*a*) of the second connector.

10. System according to claim 8, wherein each lateral branch has a set of slots (4*e*) engaging with a set of pins (6*b*) provided on the second connector.

* * * * *